United States Patent [19]

Legere

[11] Patent Number: 4,911,999

[45] Date of Patent: Mar. 27, 1990

[54] ELECTROSTATIC MASTER CONTAINING THIOUREA OR THIOAMIDE ELECTROSTATIC DECAY ADDITIVE FOR HIGH SPEED XEROPRINTING

[75] Inventor: Carolyn C. Legere, Claymont, Del.

[73] Assignee: E. I. Du Pont de Nemours and Company, Wilmington, Del.

[21] Appl. No.: 284,891

[22] Filed: Dec. 13, 1988

[51] Int. Cl.[4] ..... G03G 13/28; G03G 5/026; G03C 1/68

[52] U.S. Cl. ..... 430/49; 430/281; 430/283; 430/284; 430/286; 524/910

[58] Field of Search ..... 430/281, 283, 284, 49, 430/286; 524/910

[56] References Cited

U.S. PATENT DOCUMENTS

| | | | |
|---|---|---|---|
| 2,953,505 | 9/1960 | Mones | 204/2 |
| 3,341,431 | 9/1967 | Gradsten et al. | 204/2 |
| 3,342,704 | 9/1967 | Gradsten et al. | 204/2 |
| 3,342,705 | 9/1967 | Lieblich et al. | 204/2 |
| 3,344,044 | 9/1967 | Gradsten et al. | 204/2 |
| 3,354,058 | 11/1967 | Ives | 204/2 |
| 3,469,979 | 9/1969 | Ferrarini et al. | 96/1.7 |
| 3,525,612 | 8/1970 | Holstead | 96/1 |
| 3,630,729 | 12/1971 | Bach et al. | 96/1.2 |
| 3,717,463 | 2/1973 | Bach et al. | 96/1.5 |
| 3,728,112 | 4/1973 | Chapin et al. | 96/1.2 |
| 3,754,907 | 8/1973 | Chapin | 96/1.4 |
| 4,077,802 | 3/1978 | Chapin et al. | 96/1 R |
| 4,115,289 | 9/1978 | Bach et al. | 252/62.1 P |
| 4,264,710 | 4/1981 | Kondoh | 430/281 |
| 4,681,828 | 7/1987 | Alexandrovich et al. | 430/97 |
| 4,732,831 | 3/1988 | Risesenfeld et al. | 430/49 |
| 4,814,246 | 3/1989 | Lehmenn et al. | 430/66 |
| 4,849,314 | 7/1989 | Blanchet-Fincher | 430/49 |

*Primary Examiner*—Paul R. Michl
*Assistant Examiner*—Christopher D. RoDee

[57] ABSTRACT

An improved electrostatic master is disclosed that contains a thiourea or thioamide electrostatic decay additive in a photopolymerizable composition of an ethylenically unsaturated monomer, an organic polymeric binder, and a photoinitiator system.

9 Claims, No Drawings

ELECTROSTATIC MASTER CONTAINING THIOUREA OR THIOAMIDE ELECTROSTATIC DECAY ADDITIVE FOR HIGH SPEED XEROPRINTING

FIELD OF THE INVENTION

This invention relates to an improved electrostatic master for xeroprinting and, more particularly, to an electrostatic master having a photopolymerizable surface that contains a thiourea or thioamide electrostatic decay additive.

BACKGROUND OF THE INVENTION

The xeroprinting process employs a printing plate, commonly referred to as a "master", made by creating a pattern of insulating material (i.e., an image) on the surface of a grounded conductive substrate. In the xeroprinting process, the master is exposed to an electrostatic field (e.g., by a corona discharge) that imposes an electrostatic charge on the surface of the master. The portion of the master bearing the insulating material retains the charge, while the charge on the remainder of the master is discharged through the grounded conductive substrate. Thus, a latent image of electrostatic charge is formed on the insulating material, the image subsequently being developed with oppositely charged particles commonly referred to as "toner". The toner is then transferred (e.g., by electrostatic or other means) to another surface (e.g., paper or polymeric film), where it is fused (i.e., "fixed"), to reproduce the image of the master. Since the image on the master is permanent, or at least persistent, multiple copies can be made by repeating the charging, toning and transfer steps.

Recently issued U.S. Pat. No. 4,732,831 to Riesenfeld et al. discloses an improved xeroprinting process that employs a master having a photopolymerizable coating on a conducting substrate. The coating contains an organic polymeric binder, an ethylenically unsaturated monomer, and a photoinitiator system. When the master is exposed to the desired pattern of actinic radiation (i.e., light of a suitable wavelength), exposed regions of the coating polymerize and exhibit a significantly higher electrical resistance than unexposed regions. Thus, when the master is subsequently used in the xeroprinting process, the polymerized regions will tend to hold an electrical charge, which is developed with toner, while the unpolymerized regions discharge to ground through the conductive backing and therefore do not attract the toner.

The electrostatic master of U.S. Pat. No. 4,732,831 offers a number of advantages over the prior art in that there is no development step required between creation of an image on the master and subsequent use of the master in the xeroprinting process. Although the master is well suited for many applications, however, the decay rate for unpolymerized regions is not sufficiently rapid to permit use of the master in a high speed xeroprinting process where the master will rapidly proceed through charging and toning stations. In such processes it is desired that the charge on grounded portions of the master decay to a level that will not attract toner within two (2) seconds or less after exposure to the corona discharge. Otherwise, toner may be carried over on regions of the master that are not sufficiently discharged, adversely effecting quality of the copies. Thus, there is a need for an improved master particularly suited for high speed xeroprinting.

SUMMARY OF THE INVENTION

It has now been found that the addition of thiourea or thioamide to photohardenable compositions containing an ethylenically unsaturated monomer, an organic polymeric binder, and a photoinitiator, will increase the electrostatic decay rate of regions of the photopolymer that are not polymerized, thereby enabling the achievement of higher speed xeroprinting. The addition of thiourea or thioamide, however, does not cause the polymerized portions of the photohardenable composition to unduly discharge. Thus, polymerized portions of the composition still will hold an electrostatic charge for sufficient time to be useful in the xeroprinting process. Accordingly, the present invention provides an improved electrostatic master having an electrically conductive substrate that bears a photohardenable composition containing an ethylenically unsaturated monomer, an organic polymeric binder, a photoinitiator, and a thiourea or thioamide electrostatic decay additive. Preferably, the amount of the decay additive will be sufficient to reduce the surface voltage of unpolymerized regions of the master to 5 volts or less in 2 seconds after charging.

DETAILED DESCRIPTION

Photopolymerizable compositions that may be used to advantage in practicing the invention will contain an ethylenically unsaturated monomer, an organic polymer binder, a photoinitiator system, and a thiourea or thioamide electrostatic decay additive.

Monomers

The term "monomer" as used herein includes simple monomers as well as polymers, usually of molecular weight below 1500, having ethylenic groups capable of crosslinking or addition polymerization. Any ethylenically unsaturated photopolymerizable or photocrosslinkable compound known in the art for use with hexaphenylbiimidazoles ("HABI") initiator systems, discussed hereinafter, can be used to advantage.

Preferred monomers include di-, tri-, and tetraacrylates and methacrylates such as ethylene glycol diacrylate, diethylene glycol diacrylate, triethylene glycol diacrylate, glycerol diacrylate, glycerol triacrylate, ethylene glycol dimethacrylate, 1,2-propanediol dimethacrylate, 1,2,4-butanetriol trimethacrylate, 1,4-cyclohexanediol diacrylate, 1,4-benzenediol dimethacrylate, pentaerythritol triacrylate, pentaerythritol trimethacrylate, pentaerythritol tetramethacrylate, 1,3-propanediol diacrylate, 1,5-pentanediol dimethacrylate, trimethylolpropane triacrylate, the bisacrylates and bismethacrylate of polyethylene glycols of molecular weight 10–500, and the like. Especially preferred monomers are ethoxylated trimethylolpropane triacrylates and polyethylene glycol 200 dimethacrylate. Generally the selected monomer will have a resistivity in the range of $10^5$ to $10^9$ ohm.cm. If conductivity of the polymer formed from the monomer is too high, charge will be lost from exposed regions of the master too rapidly to permit the toning and transfer steps to be accomplished.

Binders

The binder serves as a vehicle to "carry" the monomer, photoinitiator system, and electrostatic decay additive, and must have sufficiently high resistivity that charge will decay more slowly in the exposed areas than in the unexposed areas. On the other hand, if the binder resistivity is too high, the exposed area discharge rate may be too slow, resulting in overtoning of solids and overfilling of large dots. Also, unexposed regions may discharge too slowly, reducing the speed at which multiple copies can be printed. Binders having a resistivity in the range of $10^{14}$ to $10^{20}$ ohm.cm generally will be selected. Resistivities at the upper end of this range (e.g., $10^{18}$ to $10^{20}$ ohm.cm) permit a higher initial charge and slower decay rate in exposed regions. However, binders having a lower resistivity (e.g., $10^{14}$ to $10^{16}$ ohm.cm) have been found to achieve improved image quality.

Suitable binders include the polymerized methyl methacrylate resins including copolymers thereof, polyvinyl acetals such as polyvinyl butyral and polyvinyl formal, vinylidene chloride copolymers (e.g., vinylidene chloride/acrylonitrile, vinylidene chloride/methacrylate and vinylidene chloride/vinyl acetate copolymers), synthetic rubbers (e.g., butadiene/acrylonitrile copolymers and chloro-2-butadiene-1,3-polymers), cellulose esters (e.g., cellulose acetate, cellulose acetate succinate and cellulose acetate butyrate), polyvinyl esters (e.g., polyvinyl acetate/acrylate, polyvinyl acetate/methacrylate and polyvinyl acetate), polyvinyl chloride and copolymers (e.g., polyvinyl chloride/acetate), polyurethanes, polystyrene, and styrene/methyl methacrylate copolymers. Preferred binders are poly(styrene/methyl methacrylate) and poly(methyl methacrylate).

Initiator Systems

A large number of free-radical generating compounds can be utilized in the practice of this invention. Preferred initiator systems are 2,4,5-triphenylimidazol dimers with hydrogen donors, also known as the 2,2',4,4',5,5'-hexaarylbiimidazoles, or HABI's, and mixtures thereof, which dissociate on exposure to actinic radiation to form the corresponding triarylimidazolyl free radicals. Use of HABI-initiated photopolymerizable systems is well known in the art and has been previously disclosed in a number of patents. These include Chambers, U.S. Pat. No. 3,479,185; Chang et al., U.S. Pat. No. 3,549,367; Baum and Henry, U.S. Pat. No. 3,652,275; Cescon, U.S. Pat. No. 3,784,557; Dueber, U.S. Pat. No. 4,162,162; Dessauer, U.S. Pat. No,. 4,242,887; Chambers et al., U.S. Pat. No. 4,264,708; and Tanaka et al., U.S. Pat. No. 4,459,349. Useful 2,4,5-triarylimidazolyl dimers are disclosed in Baum and Henry, U.S. Pat. No. 3,652,275 column 5, line 44 to column 7, line 16. Any 2-o-substituted HABI disclosed in the prior patents can be used in this invention. Preferred HABI's are 2-o-chlorosubstituted hexaphenylbiimidazoles in which the other positions on the phenyl radicals are unsubstituted or substituted with chloro, methyl or methoxy. The most preferred initiators include CDM-HABI, i.e., 2-(o-chlorophenyl)-4,5-bis(m-methoxyphenyl)imidazole dimer; o-Cl-HABI, i.e., 1,1'-biimidazole, 2,2'-bis(o-chlorophenyl)-4,4',5,5'-tetraphenyl-; and TCTM-HABI, i.e., 1H-imidazole, 2,5-bis(o-chlorophenyl)-4-[3,4-dimethoxyphenyl]-, dimer, each of which is typically used with a hydrogen donor, or chain transfer agent.

Other useful photoinitiators include substituted or unsubstituted polynuclear quinones, aromatic ketones, and benzoin ethers. Representative quinones are: 9,10-anthraquinone; 1-chloroanthraquinone; 2-chloroanthraquinone; 2-methylanthraquinone; 2-ethylanthraquinone; 2-tert-butylanthraquinone; octamethylanthraquinone; 1,4-naphthoquinone; 9,10-phenanthrenequinone; 1,2-benzanthraquinone; 2,3-benzanthraquinone; 2-methyl-1,4-naphthoquinone; 2,3-dichloronaphthoquinone; 1,4-dimethylanthraquinone; 2,3-dimethylanthraquinone; 2-phenylanthraquinone; 2,3-diphenylanthraquinone; sodium salt of anthraquinone α-sulfonic acid; 3-chloro-2-methylanthraquinone; retenequinone; 7,8,9,10-tetrahydronaphthacenequinone; 1,2,3,4-tetrahydrobenz(a)anthracene-7,12-dione. Aromatic ketones that may be selected include, for example, benzophenone, Michler's ketone [4,4'-bis(dimethylamino)benzophenone]; (4,4'-bis(diethylamino)benzophenone; 4-acryloxy-4'-diethylaminobenzophenone; 4-methoxy-4'-dimethylaminobenzophenone; and benzoin ethers, for example, benzoin methyl and ethyl ethers. Photoinitiators described in U.S. Pat. No. 2,760,863 also may be selected, including vicinal ketaldonyl alcohols, such as benzoin; pivaloin; acyloin ethers; and α-hydrocarbon-substituted aromatic acyloins, including α-methylbenzoin, α-allylbenzoin and α-phenylbenzoin. Additional useful systems include alpha-diketones with amines as disclosed in Chang, U.S. Pat. No. 3,756,827 and benzophenone with p-dimethylaminobenzaldehyde or with esters of p-dimethylaminobenzoic acid as disclosed in Barzynski et al., U.S. Pat. No. 4,113,593.

Redox systems, especially those involving dyes (e.g., Rose Bengal/2-di-butylaminoethanol), are also useful. Photoreducible dyes and reducing agents such as those disclosed in U.S. Pat. Nos. 2,850,445; 2,875,047; 3,097,096; 3,074,974; 3,097,097; 3,145,104; and 3,579,339; as well as dyes of the phenanzine, oxazine, and quinone classes can be used to initiate photopolymerization. A useful discussion of dye sensitized photopolymeriation can be found in "Dye Sensitized Photopolymerization" by D. F. Eaton in *Adv. in Photochemistry,* Vol. 13, D. H. Volman, G. S. Hammond, and K. Gollinick, eds., Wiley-Interscience, New York, 1986, pp. 427–487.

Electrostatic Decay Additive

Electrostatic decay additives that are selected in accordance with the invention are thiourea or thioamide compounds. It has been found that these compounds can be added in small amounts to increase the electrostatic decay rate of portions of the master that have not been polymerized, yet permitting polymerized portions to retain the charge through the toning and transfer steps of the xeroprinting cycle. Since only small amounts are needed for this purpose, the photopolymerizable composition can accommodate other additives, as described hereinafter, without adversely affecting properties of the electrostatic master.

Preferred thioureas that may be selected are compounds having the following general structure:

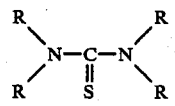

in which the R groups may be alike or different, and may be hydrogen or alkyl, typically up to 6 carbon atoms in chain length; cycloalkyl, typically of 5 to 7 carbon atoms; or aryl. The alkyl, cycloalkyl, and aryl groups may be substituted or unsubstituted. Representative thioureas wherein an R substituent(s) is alkyl include 1-allyl-2-thiourea; 1,3-dibutyl-2-thiourea; 1-ethyl-2-thiourea; glyoxaldithiosemicarbazone; and 3-amino-2-butenethioamide. A representative thiourea having a cycloalkyl substituent, that may be selected to advantage, is 1-cyclohexyl-3(2-morpholinoethyl)-2-thiourea. Diphenyl thiourea, also known as thiocarbanilide, is a thiourea having organic substituents that is particularly useful. These compounds are readily prepared by methods well known in the art. One method of preparing thioureas, for example, is by the reaction of isothiocyanates with either ammonia or with primary or secondary amines.

Another class of thiourea compounds that may be used to advantage are the alkylated and unalkylated thioenols of thioureas. A particularly useful thioenol of a thiourea is 3,4,5,6-tetrahydropyrimidine-2-thiol. The hydroiodide salt of 2-methylthio-2-imidazoline is a representative salt that may be selected.

Thioamide compounds that may be selected will generally have similar structures to thiourea compounds described above, except that there is only one nitrogen atom affixed to the thiocarbonyl moiety. Thus, thioamide will have the general structure.

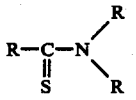

where R groups can be the same or different, and are the substituents previously described for thioureas. A particularly useful thioamide is 3-amino-2-butenethioamide.

Other Components

The photopolymerizable compositions also may contain conventional additives used in photopolymer systems, such as stabilizers, antihalation agents, optical brightening agents, release agents, surfactants, plasticizers, and the like. One of the advantages of the thiourea and thioamide electrostatic decay additives is that they are effective in small amounts, and thus permit inclusion of conventional additives without causing the additives to crystallize.

A thermal polymerization inhibitor normally will be present, for example, to increase stability for storage of the photopolymerizable composition. Useful thermal stabilizers include hydroquinone, phenidone, p-methoxyphenol, alkyl and aryl-substituted hydroquinones and quinones, tert-butyl catechol, pyrogallol, copper resinate, naphthylamines, betanaphthol, cuprous chloride, 2,6-di-tert-butyl p-cresol, phenothiazine, pyridine, nitrobenzene, dinitrobenzene, p-toluquinone and chloranil. The dinitroso dimers described in Pazos, U.S. Pat. No. 4,168,982 are also useful. A preferred stabilizer is TAOBN, i.e., 1,4,4-trimethyl-2,3-diazobicyclo-(3.2.2)-non-2-ene-N,N-dioxide.

By the incorporation of optical brightening agents into the composition, the image is produced free of distortion due to halation effects and free from discoloration due to element components. Suitable optical brighteners useful in the process of the invention include those disclosed in U.S. Pat. Nos. 2,784,183; 3,664,394; and 3,854,950. Optical brighteners that are particularly useful include 2-(stibyl-4″)-(naphto-1′,2′,4,5)-1,2,3-triazol-2″-sulfonic acid phenyl ester; and 7-(4′-chloro-6′-diethylamino-1′,3′,5′-triazine-4′-yl)amino-3-phenyl coumarin. Ultraviolet radiation absorbing materials that may be used in the composition are disclosed in U.S. Pat. No. 3,854,950. Useful release agents include polycaprolactone. Suitable plasticizers include triethylene glycol, triethylene glycol diproprionate, triethylene glycol dicaprylate, triethylene glycol bis(2-ethyl hexanoate), tetraethylene glycol diheptanoate, polyethylene glycol, diethyl adipate, tributyl phosphate, and the like. Other additives will be apparent to those skilled in the art.

Proportions

In general, the components will be used in the following approximate proportions, by weight: binder 40–75%, preferably 50–65%; monomer 15–40%, preferably 20–32%; initiator 1–20%, preferably 1–5%; chain transfer agent or hydrogen donor 0–5%, preferably 0.1–4%; thiourea or thioamide decay additive 0.1–5%, preferably 0.2–0.5%, and other ingredients 0–4%. For high speed systems sensitized to visible radiation and adapted for laser exposure, it is sometimes desirable to use up to 15% initiator. The above weight percentages based on total weight of the photopolymerizable system.

The proportions used will depend upon the particular compounds selected for each component, and upon the application for which the system is intended. For example, a high conductivity monomer may be used in smaller amount than a low conductivity monomer, since the former will be more efficient in eliminating charge from unexposed areas.

In general, it is desirable that regions of the master that are not intended to be toned discharge in two seconds or less to voltage levels that will not attract toner (i.e., to 5 volts or less). The amount of thiourea or thioamide electrostatic decay additive needed to achieve this result will vary with the particular additive that is selected. In general, it is preferred to use the lowest practical concentration of decay additive that produces acceptable charge decay in unpolymerized regions of the master to reduce any potential adverse affects on other properties of the master. Also, lower levels of addition are desirable since, in some cases, high levels may tend to cause undesired discharge in regions of the master where toning is intended.

The amount of initiator, typically HABI, will depend upon film speed requirement. Systems with HABI content above 10% provide films of high sensitivity (high speed) and can be used with laser imaging in recording digitized information, as in digital color proofing. For analog applications, e.g., exposures through a negative, film speed requirement depends upon mode of exposure. If the exposure device is a flat-bed type, in which a negative is placed over the photopolymer matrix, a 30 sec or greater exposure can be used and a slow film will be acceptable. For a drum exposure device, with a collimated source of radiation, the exposure period will be brief and a higher speed film must be used.

Coating/Substrate

The photopolymerizable composition is prepared by mixing the ingredients of the system in a solvent, such as methylene chloride, usually in the weight ratio of about 15:85 to 25:75 (solids to solvent), coating on the substrate, and evaporating the solvent. Coatings should be uniform and typically have a thickness of 3 to 15 microns, preferably 7 to 12 microns, when dry. Dry coating weight generally will be about 30 to 150 mg/dm$^2$, preferably 70 to 120 mg/dm$^2$. A release film generally is placed over the coating after the solvent evaporates.

The substrate should be uniform and free of defects such as pinholes, bumps, and scratches. It can be a support, such as paper, glass, synthetic resin and the like, which has been coated by vapor deposition or sputtering chemical deposition on one or both sides with a metal, conductive metal oxide, or metal halide, such as aluminized polyethylene terephthalate; or a conductive paper or polymeric film. Then the coated substrate can be mounted directly on a conductive support on the printing device.

Alternatively, the substrate can be a non-conducting film, preferably a release film such as polyethylene or polypropylene. After removal of the protective release film, the film can then be laminated to the conductive support on the printing device with the tacky, photohardenable layer adjacent to the support. The substrate then acts as a coversheet which is removed after exposure but prior to charging. This is preferable because it is difficult to mount an aluminized polyester film as a support without inducing defects, for example, air pockets.

As another alternative, the conductive support may be a metal plate, such as aluminum, copper, zinc, silver or the like; or a support which has been coated with a polymeric binder containing a metal, conductive metal oxide, metal halide, conductive polymer, carbon, or other conductive filler.

Electrical Characteristics

To evaluate and compare potential decay agents, voltage is measured on the unexposed photohardenable layer within 1 sec after charging, at 15 sec intervals for 1 min after charging, and at 2 min after charging, using standard conditions of charging and measuring as described in the Examples.

The desired electrical properties of the system are dependent on the charge deposited on the photosensitive surface and the electrical characteristics of the particular toner system employed. Ideally, at the time of contact with the toner dispersion, the voltage in the exposed areas (VTe) should be at least 10 V, preferably at least 100 V, more than that of the voltage in unexposed areas (VTu).

Best results are obtained when VTu has decayed to zero or near zero. Depending on the choice of toner system, VTe should be at least 10 V, preferably at least 150 V, and even up to 400 V or higher. VTu is preferably zero or near zero. If VTu is greater than 5 V, an unacceptable background is generally produced in the unexposed areas due to the acceptance and transfer of toner by the residual charge in the unexposed areas.

An ideal time for toner application is between 5 and 15 sec after charging

Exposure/Charging/Toning/Transfer

To provide the required conductivity differential, exposure must be sufficient to cause substantial polymerization in exposed areas. Exposing radiation can be modulated by either digital or analog means. Analog exposure utilizes a line or half-tone negative or other pattern interposed between the radiation source and film. For analog exposure an ultraviolet light source is preferred, since the photopolymerizable system is most sensitive to shorter wavelength light. Digital exposure may be carried out by a computer controlled, visible light-emitting laser which scans the film in raster fashion. For digital exposure a high speed film, i.e., one which contains a high level of HABI and which has been sensitized to longer wavelengths with a sensitizing dye, is preferred. Electron beam exposure can be used, but is not preferred because of the expensive equipment required. The preferred charging means is corona discharge. Other charging methods, e.g., discharge of a capacitor, can also be used. Any electrostatic liquid toner and any method of toner application can be used. Liquid toners, i.e., a suspension of pigmented resin toner particles in a dispersant liquid, are preferred. After the application of toner, the toned image is transferred to another surface, such as paper (which is particularly useful in making proofs), polymeric films, cloth, or other substrates. Transfer is generally accomplished by electrostatic techniques known in the art, but other techniques may be employed if so desired.

The photohardenable electrostatic master is particularly useful in the graphic arts field, especially in the area of color proofing wherein the proofs prepared dulicate the images produced by printing. This is accomplished by controlling the gain of the reproduced halftone dots through control of the electrical conductivity of the exposed and unexposed areas of the photohardenable electrostatic master. Since the voltage retained by the halftone dots is almost linearly related to the percent dot area, the thickness of the liquid electrostatic developer will be constant everywhere on the image, independent of the particular dot pattern to be developed. Other uses for the photopolymerizable master include preparation of printed circuit boards, resists, soldermask, and photohardenable coatings.

The invention is further illustrated by reference to the following examples, which do not limit the invention.

EXAMPLES

| EXAMPLES GLOSSARY | |
|---|---|
| ABT | 3-Amino-2-butenethioamide; CAS 62069-87-8 |
| ATU | 1-Allyl-2-thiourea; CAS 109-57-9 |
| CDM-HABI | 2-(o-chlorophenyl)-4,5-bis(m-methoxyphenyl)imidazole dimer; 1,1'-bi-1H-imidazole, 2,2'-bis(2-chlorophenyl)-4,4',5,5'-tetrakis(3-methoxyphenyl)-; CAS 29777-36-4 |
| o-Cl-HABI | 1,1'-Biimidazole, 2,2'-bis[o-chlorophenyl]-4,4',5,5'-tetraphenyl-; CAS 1707-68-2 |
| CMTU | 1-Cyclohexyl-3-(2-morpholinoethyl)-2-thiourea; CAS 21545-54-O |
| DBTU | 1,3-Dibutyl-2-thiourea; CAS 109-46-6 |
| DPTU | Thiocarbanilide; 1,3-diphenyl-2-thiourea; CAS 102-08-9 |
| ETU | 1-Ethyl-2-thiourea; CAS 625-53-6 |
| GDTS | Glyoxal dithiosemicarbazone; CAS 1072-12-44 |
| JAW | Cyclopentanone, 2,5-bis[(1 H,5 H-benzo[i,j]quinolizin-1-yl)methylene]- |
| MBO | 2-Mercaptobenzoxazole; 2-Benzoxazolethiol; CAS 2382-96-9 |
| MBT | 2-Mercaptobenzothiazole; 2-Benzothiazolethiol; CAS 49-30-4 |
| MTI | 2-Methylthio-2-imidazoline hydroiodide; |

-continued

| EXAMPLES GLOSSARY | |
|---|---|
| | CAS 5464-11-9 |
| NPG | N-phenyl glycine |
| PSMMA | 70/30 poly(styrene/methyl methacrylate) |
| TAOBN | 1,4,4-Trimethyl-2,3-diazobicyclo(3.2.2)-non-2-ene-2,3-dioxide |
| TCTM-HABI | 1H-Imidazole, 2,5-bis[o-chlorophenyl]-4-[3,4-dimethoxyphenyl]-, dimer; CAS 79070-04-5 |
| THPT | 3,4,5,6-Tetrahydro-2-pyrimidinethiol; CAS 2055-46-1 |
| TLA-454 | Tris(4-diethylamino-o-tolyl)methane; Benzeneamine, 4,4',4''-methylidynetris(N,N-diethyl-3-methyl-; CAS 4482-70-6 |
| TMPEOTA | Triacrylate ester of ethoxylated trimethylolpropane; CAS 28961-43-5 |
| TPA | Triphenylamine; CAS 603-34-9 |
| p-TSA | p-Toluene sulfonic acid; CAS 6192-52-5 |

GENERAL PROCEDURES

Except as indicated otherwise, the following procedures were used in all examples.

A solution containing about 86.5 parts methylene chloride and 13.5 parts of solids was coated onto 0.004 in (0.0102 cm) aluminized polyethylene terephthalate support. After the film had been dried at 60°-95° C. to remove the methylene chloride, a 0.0075 in (0.019 cm) polypropylene coversheet was laminated to the dried layer. The coating weights varied from 70 to 120 mg/dm$^2$. The film was then wound on rolls until exposure and development.

In order to test the image quality of each photopolymer composition, the photopolymer layer was exposed, charged, and toned with black toner, and the image transferred to paper as described below. In all cases "black toner" refers to the standard black toner used to form a four-color proof described below. The evaluation of image quality was based on dot range and dot gain on paper. The standard paper is 60 lbs Solitaire® paper, offset enamel text, Plainwell Paper Co., Plainwell, Mich. However, the variety of papers tested included: 60 lbs Plainwell offset enamel text, 70 lbs Plainwell offset enamel text, 150 lbs white regal Tufwite® Wet Strength Tag, 60 lbs White LOE Gloss Cover, 70 lbs white Flokote® Text, 60 lbs white all purpose lith, 110 lbs white Scott index, 70 lbs white Nekoosa Vellum Offset and 80 lbs white Sov® text. Results indicated that, although the process can be used with any paper, the trapping of ink varies with the fibrillar nature of the paper in use.

Dot gain or dot growth versus dot size is a standard measure of how tolerances between a proof and a press proof are determined. The dot gains were measured using specially designed patterns called Brunner targets which are available form System Brunner USA, Inc., Rye, N.Y. The dot range was easily tested using URGA targets, Graphic Arts Technical Foundation, Pittsburgh, Pa., that include 0.5% highlight dots to 99.5% shadow dots and in a 133 lines/mm screen that includes 4 micron highlights and shadow microlines.

The photohardenable electrostatic master was first exposed through a separation negative using a Douthitt Option X Exposure Unit (Douthitt Corp., Detroit, Mich.), equipped with a model TU 64 Violux 5002 Corp., Detroit, Mich.), equipped with a model TU 64 Violux 5002 lamp assembly (Exposure Systems Corp., Bridgeport, Conn.) and model No. 5027 photopolymer type lamp. Exposure times varied from 1-100 seconds depending on the formulation. The exposed master was then mounted on a drum surface. SWOP (Specification Web Offset Publications) density in the solid regions was obtained by charging the fully exposed regions of the photopolymer of the photopolymer to 100 to 200 V. The charged latent image was then developed with a liquid electrostatic developer, or toner, using a two roller toning station and the developer layer properly metered. The developing and metering stations were placed at 5 and 6 o'clock respectively. The toner image was corona transferred onto paper using 50-150 microA transfer corona and 4.35 to 4.88 kV, and −2.5 to −4.0 kV tackdown roll voltage at a speed of 2.2 in/sec (5.59 cm/sec) and fused in an oven for 10 sec at 100° C.

The dot gain curves were measured using a programmable MacBeth densitometer, Model #RD 918 (MacBeth Process Measurements, Newburgh, N.Y.) interfaced to a Hewlett Packard Computer, Model #9836. The dot gain curve was calculated by using a simple algorithn that included the optical density of the solid patch, the optical density of the paper (gloss) and the optical density of each percent dot area in the Brunner target.

Surface voltage measurements were carried out as follows: five 1 in by 0.5 in (2.52 cm by 1.27 cm) samples were mounted on a flat aluminum plate that was positioned on a friction free translational stage connected to a solenoid. The five samples were moved from position A to B, about 1 in (2.54 cm) apart, by activating the solenoid. In position A, they were placed directly under a scorotron for charging. The charging conditions were: 50-200 microamps corona current (4.35 to 5.11 kV) and 2 sec charging time. After charging was complete, the solenoid was energized and the samples moved to B, away from the scorotron and directly under Isoprobe electrostatic multimeters (Model #174, manufactured by Monroe Electronics, Lyndonville, N.Y.). The outputs from the multimeters were fed into a computer (Model #9836, manufactured by Hewlett Packard, Palo Alto, Calif.) through a data acquisition box (Model #3852A, manufactured by Hewlett Packard, Palto Alto, Calif.) where the voltage versus time was recorded for each sample. Since movement of the samples took about 1 sec, the "zero time" measurement was made about 1 sec after charging.

A four color proof is obtained by following the steps described below. First, complementary registration marks are cut into the photopolymerizable layers of the masters prior to exposure. Masters for each of the four color separations are prepared by exposing four photopolymerizable elements to one of the four color separation negatives corresponding to cyan, yellow, magenta and black colors. Each of the four photopolymerizable masters is exposed for about 3 seconds using the Douthitt Option X Exposure Unit described above. The visible radiation emitted by this source is suppressed by a UV light transmitting, visible light absorbing Kokomo® glass filter (No. 400, Kokomo Opalescent Glass Co., Kokomo, Ind.), and the total emitted intensity is reduced by 75% with the use of a 25% transmission screen. The cover sheets are removed, and each master is mounted on the corresponding color module drum, in a position assuring image registration of the four images as they are sequentially transferred from each master to the receiving paper. The leading edge clamps are also used to ground the photopolymer aluminized backplane to the drum. The masters are stretched by spring loading the trailing edge assuring that each laid flat against its drum.

Each module comprised a charging scorotron at 3 o'clock position, a developing station at 6 o'clock, a metering station at 7 o'clock and a cleaning station at 9 o'clock. The charging, toning and metering procedure is similar to that described above prior to the examples. The transfer station consists of a tackdown roll, a transfer corona, paper loading, and a positioning device that fixes the relative position of paper and master in all four transfer operations.

In tbe preparation of the four-color proof the four developers, or toners, have the following compositions:

| INGREDIENTS | AMOUNT (g) |
|---|---|
| BLACK | |
| Copolymer of ethylene (89%) and methacrylic acid (11%), melt index at 190° C. is 100, Acid No. is 66 | 2,193.04 |
| Sterling NF carbon black | 527.44 |
| Heucophthal Blue, G XBT-583D Heubach, Inc., Newark, NJ | 27.76 |
| Basic Barium Petronate ® | 97.16 |
| Aluminum tristearate, Witco 132 | 27.76 |
| Isopar ®-L, non-polar liquid having a Kauri-Butanol value of 27, Exxon Corporation | 13,047.0 |
| CYAN | |
| Copolymer of ethylene (89%) and methacrylic acid (11%), melt index at 190° C. is 100, Acid No. is 66 | 3,444.5 |
| Ciba-Geigy Monarch Blue X3627 | 616.75 |
| Dalamar® Yellow YT-858D Heubach, Inc., Newark, NJ | 6.225 |
| Aluminum tristearate, Witco 132 | 83.0 |
| Basic Barium Petronate ® | 311.25 |
| Isopar ®-L, non-polar liquid having a Kauri-butanol value of 27, Exxon Corporation | 1,660.0 |
| MAGENTA | |
| Copolymer of ethylene (89%) and methacrylic acid (11%), melt index at 190° C. is 100, Acid No. is 66 | 4,380.51 |
| Mobay RV-6700, Mobay Chemical Corp., Haledon, NJ | 750.08 |
| Mobay RV-6713, Mobay Chemical Corp., Haledon, NJ | 750.08 |
| Aluminum tristearate, Witco 132 | 120.014 |
| Triisopropanol amine | 75.008 |
| Basic Barium Petronate ® | 720.08 |
| Isopar ®-L, non-polar liquid | 32,540.0 |
| YELLOW | |
| Copolymer of ethylene (89%) and methacrylic acid (11%), melt index at 190° C. is 100, Acid No. is 66 | 1,824.75 |
| Yellow 14 polyethylene flush Sun Chemical Co. | 508.32 |
| Aluminum tristearate, Witco 132 | 46.88 |
| Basic Barium Petronate ® | 59.5 |
| Isopar ®-L, non-polar liquid having a Kauri-butanol value of 27, Exxon Corporation | 11,570.0 |

First, the yellow master is charged, developed and metered. The transfer station is positioned and the toned yellow image transferred onto the paper. After the yellow transfer is completed, the magenta master is corona charged, developed and metered, and the magenta image transferred, in registry, on top of the yellow image. Afterwards, the cyan master is corona charged, developed, and metered, and the cyan image is transferred on top of the two previous images. Finally, the black master is corona charged, developed, metered, and the toned black image transferred, in registry, on top of the three previously transferred images. After the procedure is completed, the paper is carefully removed from the transfer station and the image fused by 15 seconds at 100° C.

The parameters used for preparation of the proof are: drum speed, 2.2 inches/sec. (5.588 cm/sec.); grid scorotron voltage, 100 to 400 V; scorotron current 200 to 800 uA (5.11 to 5.84 kV); metering roll voltage, 20 to 50 V; tackdown roll voltage, −2.5 to −5.0 kV; transfer corona current, 50 to 150 uA (4.35 to 4.88 kV); metering roll speed, 4 to 8 inches/sec (10.16 to 20.32 cm/sec ); metering roll gap, 0.002 to 0.005 inch (0.51 to 0.0127 mm); developer conductivity 12 to 30 picomhos/cm; developer concentration, 1 to 1.5% solids.

CONTROL EXAMPLES A–E AND EXAMPLE 1

Control Example A shows the decay of charge from the surface of an unpolymerized monomer/binder composition in the absence of a decay additive. Control examples B–E demonstrate the effect of prior art decay additives on the decay of charge from the surface of unpolymerized monomer/binder composition. Example 1 demonstrates the effect of ATU on the decay of charge from the surface of an unpolymerized monomer/binder composition.

A solution containing about 86.5 parts methylene chloride and 13.5 parts of solids was coated onto 0.004 in (0.0102 cm) aluminized polyethylene terephthalate support. The solids consisted of TMPEOTA and PSMMA in a ratio of 3/7 plus the decay additive, if any, at the level indicated in the table. Coating weights varied from about 70 to about 120 mg/dm$^2$ or corresponding to a thickness of about 7 to 12 millimicrons for the monomer/binder layer.

| Example | Decay Additive (% of Total Solids) |
|---|---|
| A | None |
| B | TPA (5%) |
| C | p-TSA (2%) |
| D | TLA-454 (2%) |
| E | p-TSA (2%) + TLA-454 (2%) |
| 1 | ATU (5%) |

| Time After Charging (sec) | Voltage Retained (volts) | | | | | |
|---|---|---|---|---|---|---|
| | A | B | C | D | E | 1 |
| 0 | 332 | 346 | 58 | 121 | 48 | 5 |
| 5 | 178 | 154 | 22 | 49 | 9 | 4 |
| 10 | 147 | 107 | 15 | 33 | 5 | 3 |
| 15 | 132 | 87 | 12 | 25 | 5 | 3 |
| 30 | 110 | 62 | 8 | 13 | 4 | 3 |
| 60 | 87 | 34 | 6 | 6 | 3 | |
| 90 | 74 | 34 | 5 | 4 | 3 | |
| 120 | 63 | 29 | | 4 | 4 | |

EXAMPLE 2

Example 2 demonstrates the effect of various decay additives of this invention on the decay of charge from the surface of an unpolymerized monomer/binder composition.

Coatings consisting of TMPEOTA and PSMMA in a ratio of 3/7 plus the decay additive, if any, at 3% of total solids were prepared as described in Example 1.

The voltage retained 5 sec after charging ($V_5$) was measured as described in the general procedures.

| Decay Additive | % of Total Solids | $V_5$ (volts) |
|---|---|---|
| None | | 5 |
| ATU | 0.4 | 2 |
| ETU | 1.0 | 2 |
| DBTU | 1.0 | 2 |
| ABT | 1.0 | 0 |
| CMTU | 1.0 | 2 |
| THPT | 4.0 | 2 |
| GDTS | 4.0 | 2 |
| MTI | 2.0 | 0 |

EXAMPLE 3

This example illustrates the effect of different concentrations of charge decay additive on the decay of charge from the exposed and unexposed areas of the photohardenable electrostatic master. Compositions F, G, and H, described in the table, were prepared and coated to produce photohardenable electrostatic masters.

| INGREDIENT | COMPOSITION (weight %) | | |
|---|---|---|---|
| | F | G | H |
| PSMMA | 58.78 | 59.03 | 59.24 |
| TMPEOTA | 30.76 | 30.91 | 31.02 |
| TCTM-HABI | 6.49 | 6.50 | 6.50 |
| MBO | 3.00 | 3.02 | 3.00 |
| ATU | 1.00 | 0.50 | 0.20 |
| TAOBN | 0.04 | 0.04 | 0.04 |

The voltage retained on the surface of the unexposed areas 5 sec after charging ($V_5$) and the voltage retained on the surface of the exposed areas 15 sec and 120 sec ($V_{15}$ and $V_{120}$) were measured as described in the general procedures.

| INGREDIENT | COMPOSITION (weight %) | | |
|---|---|---|---|
| | F | G | H |
| ATU | 1.0 | 0.5 | 0.2 |
| $V_5$ UNEXPOSED (volts) | 0 | 0 | 0 |
| $V_{15}$ EXPOSED (volts) | 1053 | 1206 | 1326 |
| $V_{120}$ EXPOSED (volts) | 542 | 761 | 868 |

EXAMPLE 4–6

These examples illustrates the use of photohardenable electrostatic masters to prepare proofs by means of analog exposure utilizing a negative interposed between the radiation source and the film.

Three photohardenable electrostatic masters, each containing a different photohardenable layer as described by compositions F, G, and H in Example 4 were prepared. Each was exposed to a mixture of ultraviolet and visible radiation from a Douthitt Option X Exposure Unit, without the visible filter, through a Brunner target and through a URGA target, charged, toned with black toner, and the toner transferred to paper. Imaging energies used were 20 mJ/cm$^2$ for F and 10 mJ/cm$^2$ for both G and H.

From the photohardenable electrostatic master containing composition F, a proof with a dot range of 3–97% dots, +14 dot gain, and an optical density of 1.49 was obtained. From the photohardenable electrostatic master containing composition G, a proof with a dot range of 1–97% dots, +12 dot gain, 4 micron resolution, and an optical density of 1.81 was obtained. From the photohardenable electrostatic master containing composition H, a proof with a dot range of 2–98% dots, +15 dot gain, 8 micron resolution, and an optical density of 1.76 was obtained.

The following two examples illustrates the use of photohardenable electrostatic masters containing visible sensitizers to prepare proofs by means of a computer controlled, visible light-emitting laser.

EXAMPLE 7

The following composition was prepared: 2333 g methylene chloride, 550 g PSMMA (55.0% of solids), 285 g TMPEOTA (28.5%), 106 g o-Cl HABI (10.6%), 39 G 2-MBO (3.9%), 1.0 g ATU (0.1%), 19 g DMJDI (1.9%), and 0.3 g TAOBN (0.03%). The solution was stirred for 24 hr to properly dissolve all the components. It was coated onto aluminized polyethylene terephthalate at 150 ft/min (45.7M/min) coating speed. Coating weight was 110 mg/dm$^2$. A polypropylene cover sheet was placed on the photopolymer surface immediately after drying. A piece of film about 20 in ×30 in was exposed with the 488 nm line of an argon ion laser operating at 2.5 W (9.42 mJ/cm$^2$). After removal of the polypropylene cover sheet, the master was charged, toned with black toner, and the toner transferred to paper. A proof with a dot range of 3–98% dots, +15 dot gain, 10 micron resolution, and an optical density of 1.63 was obtained. The energy required for imaging was 1.6 mJ/cm$^2$.

EXAMPLE 8

The following composition was prepared: 2333 g methylene chloride, 550 g PSMMA (55.0% of solids), 285 g TMPEOTA (28.5%), 106 g o-Cl HABI (10.6%), 39 g 2-MBO (3.9%), 1.0 g ATU (0.1%), 16 g DMJDI (1.6%), 3 g JAW (0.3%), and 0.3 g TAOBN (0.03%). The solution was stirred for 24 hr to properly dissolve all the components. It was coated and exposed as described in Example 8. Coating weight was 114 mg/dm$^2$. After removal of the polypropylene cover sheet, the master was charged, toned with black toner, and the toner transferred to paper. A proof with a dot range of 2–98% dots, +15 dot gain, 6 micron resolution, and an optical density of 1.54 was obtained. The energy required for imaging was 0.8 mJ/cm$^2$.

EXAMPLE 9

This example illustrates the use of the photohardenable electrostatic master to prepare a four color proof.

The following composition was prepared: 2333 g methylene chloride, 530 g PSMMA (53.0% of solids), 290 g TMPEOTA (29.0%), 155 g o-Cl HABI (15.5%), 1.0 g NPG (0.1%), 5.0 g ATU (0.5%), 15 g DMJDI (1.5%), 3 g JAW (0.3%), and 0.3 g TAOBN (0.03%). After the solution was stirred for 24 hr to properly dissolve all the components, it was coated onto aluminized polyethylene terephthalate at 150 ft/min (45.7 M/min) coating speed. Coating weight was 121 mg/dm$^2$. A polypropylene cover sheet was placed on the photopolymer surface immediately after drying. The material thus formed was cut into four pieces about 20 in ×30 in for preparation of a four color proof.

A four color proof was obtained by following the general procedure for a four color proof with the exception that the masters were exposed with the 488 nm line of an argon ion laser instead of with a Douthitt Option X Exposure Unit. Exposure energy was about 4 $mJ/cm^2$.

What is claimed is:

1. In an electrostatic master comprising an electrically conductive substrate that supports a photopolymerizable composition of an ethylenically unsaturated monomer, an organic polymeric binder, and a photoinitiator system, the improvement wherein the photopolymerizable composition contains a thiourea or thioamide electrostatic decay additive in an effective amount to increase the electrostatic decay rate of the master.

2. The electrostatic master of claim 1 wherein the electrostatic decay additive is selected from the group consisting of 1-allyl-2-thiourea; 1,3-dibutyl-2-thiourea; diphenyl thiourea; and 1-ethyl-2-thiourea.

3. The electrostatic master of claim 1 wherein the thiourea electrostatic decay additive is a thioenol of thiourea.

4. The electrostatic master of claim 1 wherein the electrostatic decay additive is a thioamide.

5. The electrostatic master of claim 1 wherein the thiourea or thioamide electrostatic decay additive is present in an amount effective to reduce the surface voltage of unpolymerized regions to less than 5 volts in 2 seconds.

6. The electrostatic master of claim 5 wherein the electrostatic decay additive is present in the amount of 0.1 to 5% of the photopolymerizable composition, by weight.

7. The electrostatic master of claim 6 wherein the electrostatic decay additive is selected from the group consisting of 1-allyl-2-thiourea; 1,3-dibutyl-2-thiourea; diphenyl thiourea; and 1-ethyl-2-thiourea.

8. The electrostatic master of claim 6 wherein the thiourea electrostatic decay additive is a thioenol of thiourea.

9. The electrostatic master of claim 6 wherein the electrostatic decay additive is a thioamide.

* * * * *